United States Patent [19]

Gutnecht

[11] Patent Number: 4,951,887

[45] Date of Patent: Aug. 28, 1990

[54] SCREW MILL FOR COMMINUTING AND COMPRESSING MATERIAL FOR GRINDING

[76] Inventor: Max Gutnecht, Uf Punten, Niederneunforn, Switzerland

[21] Appl. No.: 281,119

[22] Filed: Dec. 7, 1988

[30] Foreign Application Priority Data

Dec. 7, 1987 [CH] Switzerland ..... 4778/87

[51] Int. Cl.[5] ..... B02C 18/06

[52] U.S. Cl. ..... 241/260.1; 241/261

[58] Field of Search ..... 241/236, 260.1, 261

[56] References Cited

U.S. PATENT DOCUMENTS

| | | | |
|---|---|---|---|
| 250,432 | 6/1881 | Forster | 241/260.1 |
| 469,097 | 2/1892 | Seaberg | 241/260.1 |
| 3,533,563 | 10/1970 | Eriksson | 241/261 X |
| 4,284,247 | 8/1981 | Eriksson | 241/260.1 |
| 4,446,809 | 8/1984 | Kissel et al. | 241/260.1 X |
| 4,638,954 | 1/1987 | Poss | 241/260.1 X |
| 4,713,256 | 12/1987 | Chaveron et al. | 241/260.1 X |
| 4,783,010 | 11/1988 | Kissel | 241/260.1 X |

FOREIGN PATENT DOCUMENTS

| | | | |
|---|---|---|---|
| 108763 | 5/1983 | European Pat. Off. . | |
| 2131342 | 11/1982 | United Kingdom | 241/260.1 |

*Primary Examiner*—Timothy F. Eley

*Attorney, Agent, or Firm*—Helfgott & Karas

[57] ABSTRACT

A screw mill comprises two motor-driven conveyor screws mounted in rotary manner in a casing. Each of the conveyor screws is subdivided into two portions. A first portion is constructed as a cooperating conveyor screw pair located in a common working area, while in a second portion the conveyor screws are located in separate working areas and from separate outlets. On the one hand, this avoids the occurrence of lateral forces and, on the other hand, due to the lack of constrictions in the working areas, ensures a high processing capacity.

5 Claims, 6 Drawing Sheets

SCREW MILL FOR COMMINUTING AND COMPRESSING MATERIAL FOR GRINDING

BACKGROUND OF THE INVENTION

The invention relates to a screw mill for comminuting and compressing a material used for grinding. A screw mill of the type under discussion comprises two motor-driven conveyor screws or screw conveyors mounted in rotary, juxtaposed manner in a casing. A charging opening is provided in the casing crest on the inlet side and a shaping and compressing head is positioned in the casing end on the outlet side.

Screw mills for comminuting and compressing grinding material are known in various different constructions. A rough distinction is provided by the number of conveyor screws used, i.e. one, two or more screws. A further distinction is possible as to whether additional means are used in the form of nozzles and orifice plates in order to bring about an additional grinding and compressing.

In a known screw press of this type disclosed in EP 108763, the casing comprises casing elements, in which are mounted two conveyor screws formed from screw elements. Between the casing elements, are arranged orifice plates, which block the passage of the conveyor screws with the exception of a relatively small constriction or throttle gap. The conveyor screws are driven by means of a gear and the shafts of said screws extend through the gear and are supported on a journal bearing, which is fixed to the casing by means of draw rods.

The purpose of the known screw press is that it can be used, without significant reconstruction, for processing widely differing materials. The pressed out liquid is sucked off and the solid can be dried and briquetted by a shaping head. Although the use of orifice plates makes it possible to open up the grinding material, particularly organic material, due to the movement on the orifice plate, i.e. the cell walls are opened, considerable wear takes place on the orifice plates and even when the coating is of hard metal, a considerable amount of wear still occurs. The further disadvantage is that the use of orifice plates or similar constricting members leads to a reduction in the processing capacity.

SUMMARY OF THE INVENTION

It is an object of the present invention to provide an improved screw mill for comminuting and compressing materials.

According to the present invention, a screw mill is provided in which two juxtaposed conveyor screws are used, but there are no orifice plates or other constricting members.

It is another object of the present invention to bring about a considerable increase in the grinding material processing capacity, whilst, at the same time, reducing wear to the conveyor screws and in the casing, whilst still ensuring a complete opening up of the cell walls.

According to the invention this and other objects are attained by a screw mill, wherein two conveyor screws are subdivided into two different portions, whereof in a first inlet-side portion the conveyor screws are constructed as a cooperating conveyor screw pair located in a common working area and which mesh with one another and the conveyor screws in a second outlet-side portion forming the shaping and compressing head are constructed as individual conveyor screws with separate working areas. Thus, as a result of the inlet-side, cooperating conveyor screw pair, a large amount of grinding material can be processed, which is pressed against the second conveyor screw pair, so that a corresponding pressing or compressing action is exerted on the material located in the second conveyor screw pair. This pressing action is further increased if the conveyor screws in the first portion have a larger diameter than that in the second portion.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENTS

Figure 1:
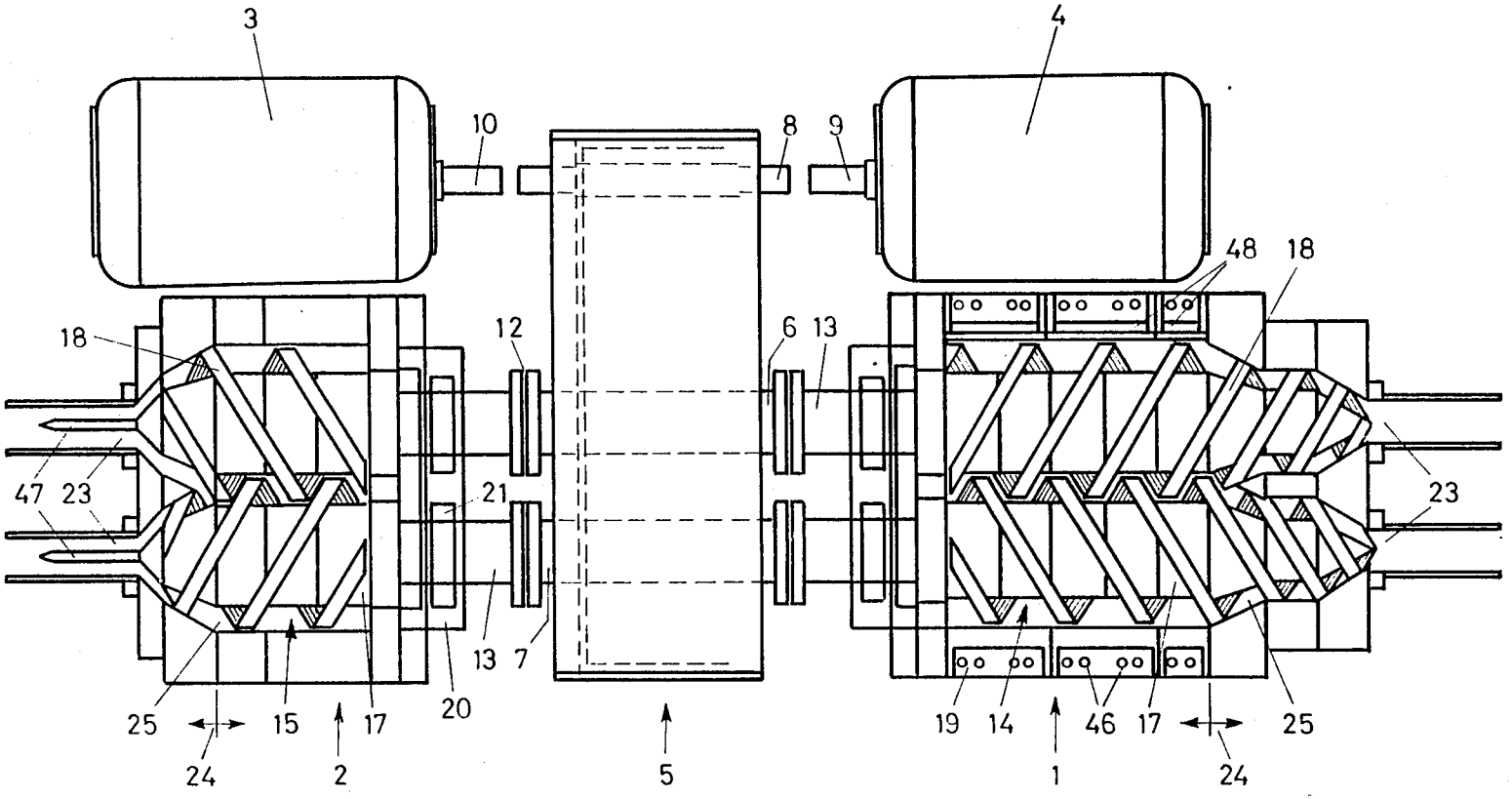
FIG. 1 is a schematic view, partly in section, of an installation with two screw mills, which are driven by means of a common gear and two motors.

The installation shown in FIG. 1 has two screw mills, 1, 2 which are driven by two electric motors 3, 4. The two screw mills 1, 2 are driven by electric motors 3, 4 by means of a reduction gear 5. The later can have a multistage construction and has two driver shafts 6, 7, which rotate in the same or opposite direction. The rotation direction of the driven shafts 6, 7 is chosen in accordance with the design of the screw mills 1, 2. A driving shaft 8 of the reduction gear 5 is connected to motor shafts 9, 10 by means of not shown but known shaft couplings.

The two driven shafts 6, 7 of the reduction gear are connected by means of shaft couplings 12, e.g. flange couplings, to driving shafts 13 of the screw mills 1, 2. Each of the screw mills 1, 2 has two driving shafts, which in each case drives a conveyor screw 14, 15.

The two screw mills 1, 2 have an essentially identical construction, but the conveyor screws 14 in screw mill 1 comprises a larger number of conveyor screw portions 17 than that of screw mill 2. The conveyor screw portions 17 are provided with screw channels 18, which partly interengage. The conveyor screws 14, 15 are mounted in a casing 19 which, as can be seen relative to screw mill 1, comprises a plurality of portions, whose length can be one or several times that of the conveyor screw portions 17. The casing has a cavity 48 for the passage of a cooling or heating medium for controlling the temperature of the material to be processed. On the driving shaft side, a bearing housing 20 is fixed to the casing of the two screw mills 1, 2, in which is housed a mounting support 21 of the conveyor screws 14, 15. The mounting support 21 is only diagrammatically shown and, as a function of the size of the screw mill, comprises bearings, generally antifriction bearings, for absorbing radial and axial forces which occur in operation.

The conveyor screws 14, 15 of the two screw mills 1, 2 are each subdivided into two portions, whereof in a first, inlet-side portion, the conveyor screws 14, 15 are each constructed as a cooperating, meshing conveyor screw pair located in a common working area. To the first inlet-side portion is connected a second, outlet-side portion, which forms a shaping and compressing head with two outlets 23.

The difference between the conveyor screws of the second, outlet-side portion and the conveyor screws of the outlet-side portion is that the screws in the first portion do not cooperate and are instead constructed as individual conveyor screws with separate working areas. The separating line between the two portions is indicated by a double arrow 24. Thus, the screw mill 1 has in its first portion five conveyor screw portions 17, whilst the second portion has three conveyor screw portions 17. In the case of the screw mill 2 the first portion comprises three conveyor screw portions 17 and the second portion includes two conveyor screw portions 17.

The conveyor screws of the second portion are housed in separate working areas and have a smaller diameter on their conveyor screw portions. The transition from the first to the second portion takes place through a conical conveyor screw portion 25. The construction of the second portion of the conveyor screws will be described in detail relative to FIGS. 3 to 6.

Figure 2:
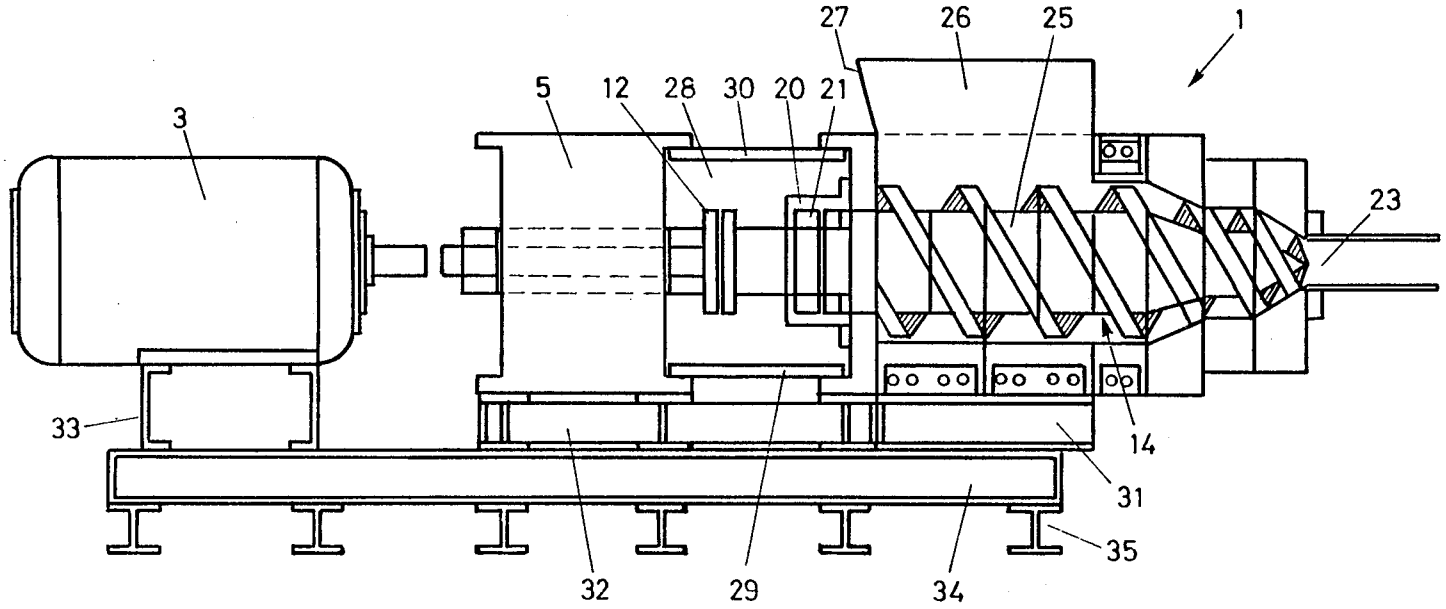
FIG. 2 is a side view of an installation with a screw mill, partly in section.

FIG. 2 shows an installation with only a single screw mill 1, which is driven by electric motor 3 via reduction gear 5. The screw mill 1 of the construction shown in FIG. 1 is, however, shown in side view, so that only the conveyor screw 14 is visible. Therefore the same reference numerals are used, and a further detailed description will not be given.

FIG. 2 also shows a charging opening 26, which is surrounded by a hopper 27. It is also possible to see in FIG. 2 that an intermediate casing 28 is arranged between the reduction gear 5 and the screw mill 1, its bottom 29 and top 30 being visible.

The screw mill 1, reduction gear 5 and electric motor 3 are in each case supported on base portions 31, 32, 33, which are in turn mounted on a bedplate 34. The substantially box-shaped bedplate 34 is supported by a plurality of beams 35 by means of which the bedplate 34 is connected to the not shown ground or floor.

Figure 3:
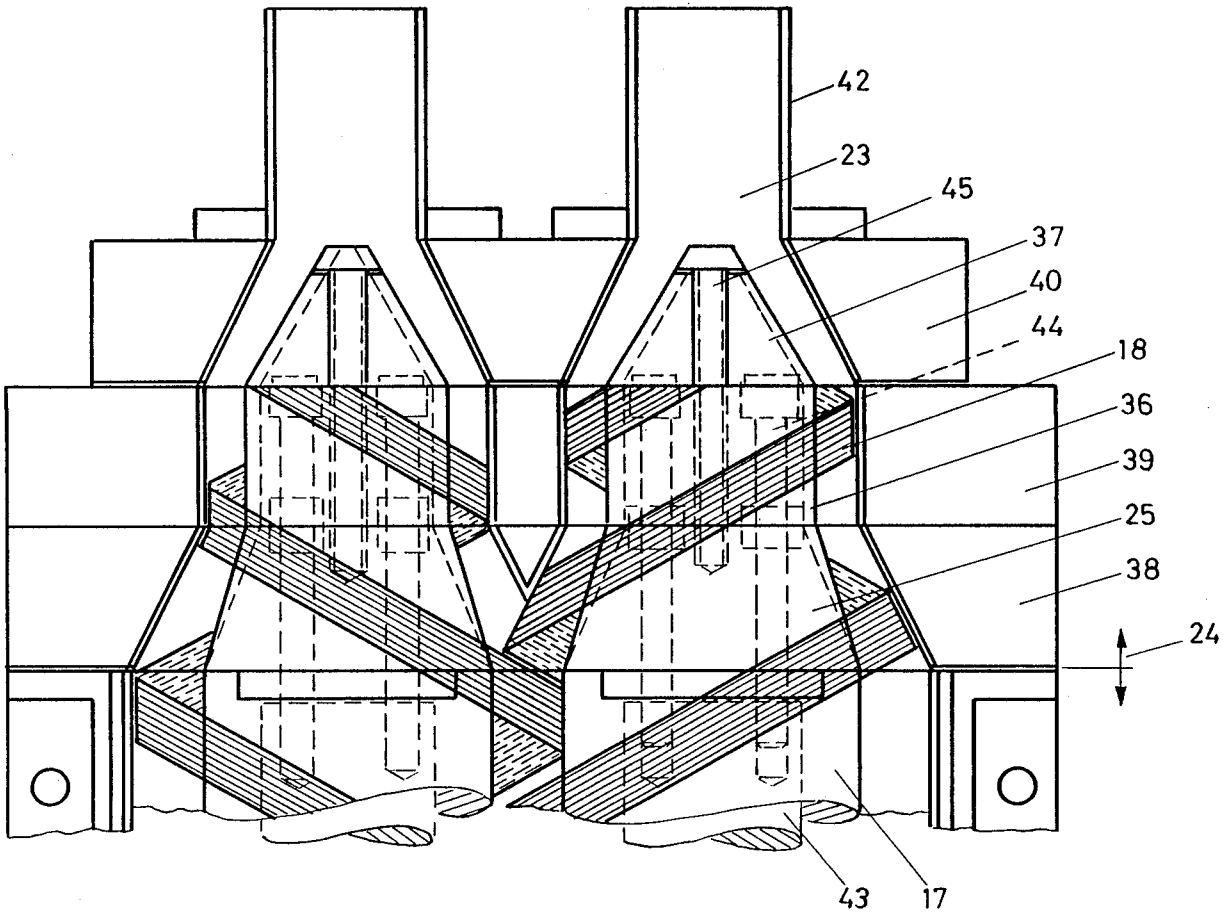
FIG. 3 is a horizontal section view through a shaping and compressing head of a screw mill with two conveyor screws arranged in separate working areas with conical and cylindrical conveyor screw portions and with an outlet connection.

FIG. 3 shows the second portion of a screw mill constructed as a shaping and compressing head. The conical conveyor screw portion 25 is connected to the conveyor screws of the first screw mill portion. This is followed by a cylindrical conveyor screw portion 36 and finally an end portion 37. Casing portions 38, 39, 40 are associated with the conveyor screw portions 25, 36, 37. A cylindrical die 42 is fixed to the outlet 23 of casing portion 40 and is used for shaping the exciting, treated material.

FIG. 3 shows a draw rod 43 terminating in the first portion and on which are arranged and fixed the conveyor screw portions 17 of the first portion. The conical conveyor screw portion 25 and the cylindrical conveyor screw portion 36 are screwed by a screw 45 on the conical conveyor screw portion 25 to the draw rod 43. To permit easier viewing, the screw channels 18 are indicated by lines. However, in reality, the channels 18 are helical, radially projecting webs. FIG. 3 clearly shows that the separation of the two conveyor screws into separate working areas starts in the casing portion 38 with the conical conveyor screw portion 25.

Figure 4:
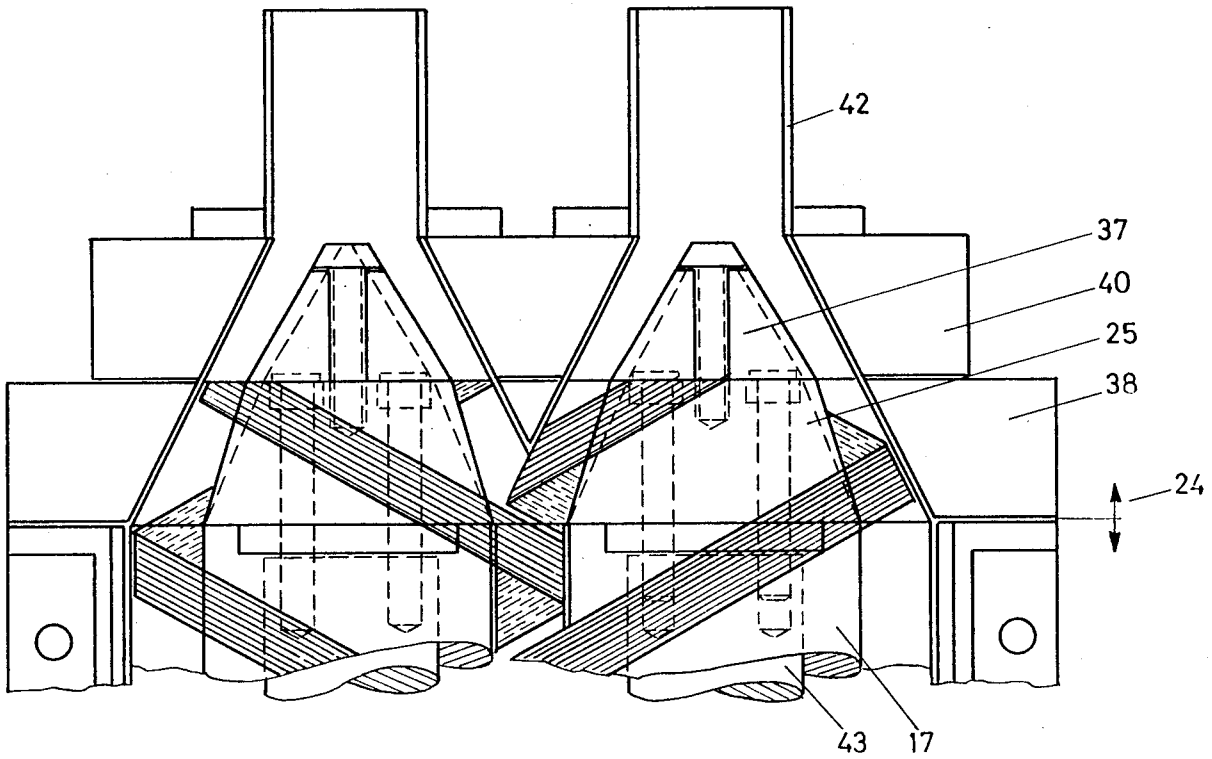
FIG. 4 is a horizontal section view through a shaping and compressing head with two conveyor screws arranged in separate working areas with conical screw portions and with an outlet connection.

FIG. 4 shows a second embodiment of the second portion of the conveyor screws. The first portion with the cylindrical conveyor screw portions 17 ends at double arrow 24, where the second portion with the conical conveyor screw portion 25 in casing portion 38 commences. This is followed by the end portion 37 with the casing portion 40, without cylindrical conveyor screw portion 36 being inserted between the conveyor screw portion 25 and the end portion 37. The construction of the second portion is slightly modified as compared with FIG. 3 and this makes it possible to adapt the screw mill to different materials to be processed. In the construction according to FIG. 4, the die 42 is the same as in the construction of FIG. 3. The fixing of the conical conveyor screw portion 25 and end portion 37 also takes place in the same way as in FIG. 3.

Figure 5:
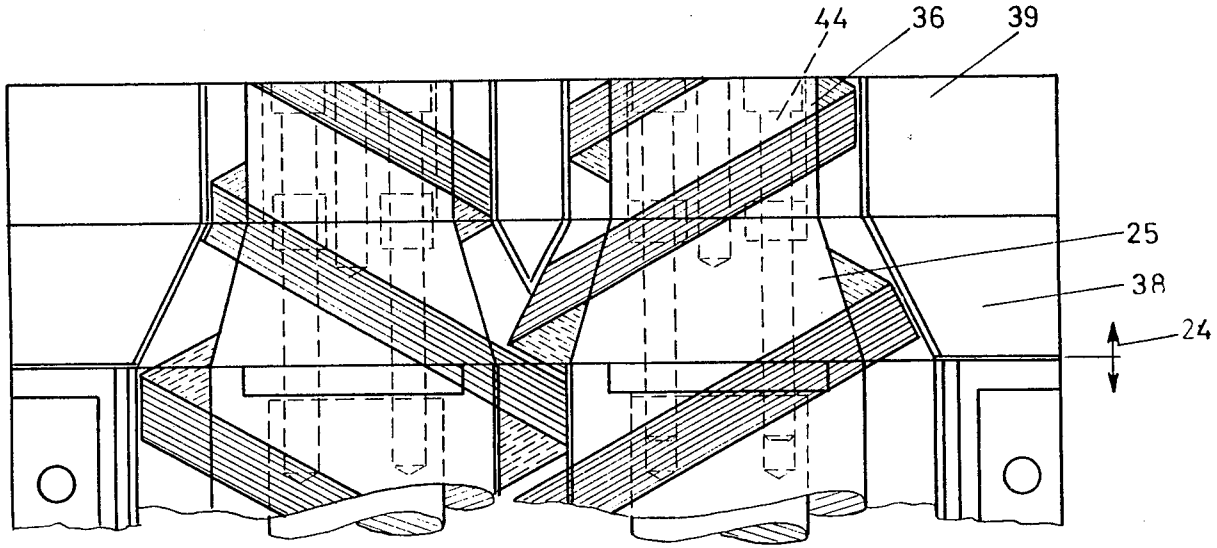
FIG. 5 is a horizontal section view through a shaping and compressing head of a screw mill with two conveyor screws arranged in separate working areas having a conical and a cylindrical screw portion, but without an outlet connection.

FIG. 5 shows another embodiment of the second portion of the screw mill, in which use is made solely of the conical conveyor screw portion 25 and the cylindrical conveyor screw portion 36 with their corresponding casing portions 38, 39. The end portion 40 and die 42 have been omitted, so that the exiting, processed material passes out in the form of a hollow cylinder, which is advantageous when processing certain materials.

Figure 6:
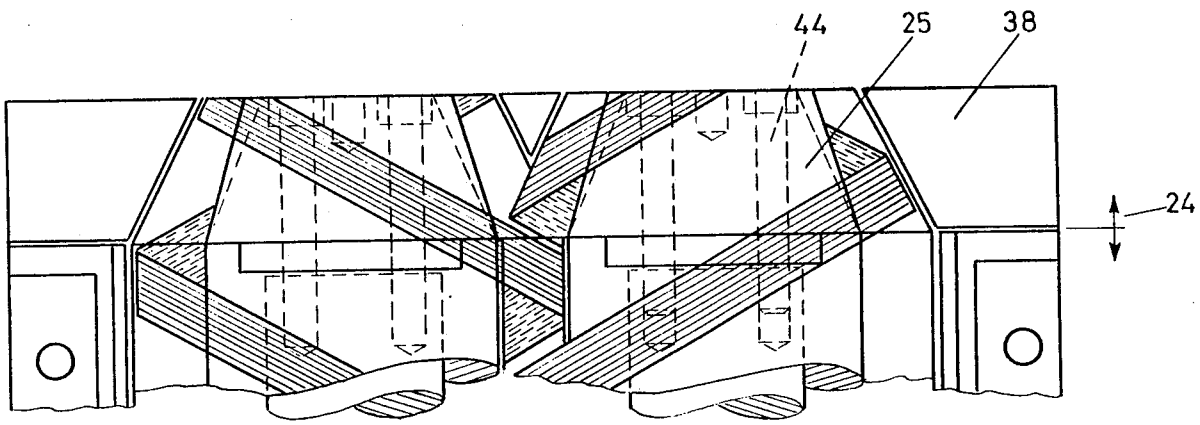
FIG. 6 is a horizontal section view through a shaping and compressing head of a screw mill with two conveyor screws arranged in separate areas and having a single, conical screw portion.

FIG. 6 shows another embodiment of the second portion of the screw mill, which only has the conical conveyor screw portion 25 with the casing portion 38. This embodiment of the second portion can also be advantageous for the processing of certain materials. The screw mill 1, 2 can be further adapted to the material to be processed, in that the casing 19 is constructed in such a way that the conveyor screws 14, 15 can be both heated and cooled. In order to achieve adequate accessibility to the conveyor screws 14, 15, the casing 19 or casing portions are constructed in two-part form and held together by screws, bores 46 of which are shown in screw mill 1 in FIG. 1. Obviously, screw mill 2 can be constructed in the same way.

As has been stated, the screw mill described is suitable for processing various materials and in particular organic materials. It is characterized by a high processing capacity. If the material to be processed is briquetted, the processing capacity can be three or more times greater than that of a comparable screw press with constrictions. The processing capacity is particularly high when producing granular materials, where in the case of the embodiment according to FIGS. 5 and 6 there is a loose discharge. The processing capacity can be ten or more times higher than that of a comparable screw press with constrictions. Despite the omission of constrictions the screw mill 1, 2 still leads to a high compression of the material, in that the second portion of the screw mill has smaller throughflow cross-sections, so that the material processed in the first portion during its transfer is pressed with a high pressure against the second portion of the screw mill. The subdivision of the screw mill in the second portion into two separate working areas has the important advantage that due to the lack of lateral forces there is no need for a mounting support for the conveyor screw portions 25, 36, 37, which simplifies the construction to a considerable extent. The exiting material can be brought into the desired form either by special die 42 or in the particular casing portions. In connection with screw mill 2, FIG. 1 also shows the use of central pins 47 having acute tips. As a result, a bore can be made in the exiting material and this can serve as a steam collector and outlet. It is important that with all the described mills when processing organic materials the flow are reliably opened up, i.e. the cell wall is opened. When processing the material heat is evolved through the grinding friction in the first and second portions of the screw mill, whereby the temperature can be kept at a given value by heating or cooling.

There has been disclosed heretofore the best embodiment of the invention presently contemplated. However, it is to be understood that various changes and modifications may be made thereto without departing from the spirit of the invention.

What is claimed is:

1. A screw mill for comminuting and compressing a material for grinding, comprising a casing, two motor-driven rotary conveyor screws positioned in said casing in parallel with each other, said casing having an inlet side provided with a charging opening and a shaping and compressing head at an outlet side thereof, each of said conveyor screws including a first portion having threads thereon and a second portion integral with said first portion and also having threads thereon and being of a smaller diameter than that of said first portion, the first portions of said two conveyor screws being positioned so that the threads thereof mesh with each other to form a cooperating conveyor screw pair having a common working area whereas the second portions of said conveyor screws are spaced from each other so that the threads of said second portion of one conveyor screw are radially spaced from the threads of the second portion of the other conveyor screw, said second portions forming two individual conveyor screws with separate working areas in said shaping and compressing head, wherein a transition from the diameter of the conveyor screws of the first portion of the smaller diameter of the screws of the second portion is constructed as a conical conveyor screw portion.

2. Screw mill according to claim 1, wherein the second portion of each of the conveyor screws is subdivided into a conical conveyor screw portion and a cylindrical conveyor screw portion, said conveyor screw portions being arranged in respective portions of said casing.

3. Screw mill according to claim 2, further including a die fixed at an outlet of each of the individual conveyor screws of the second portion.

4. Screw mill according to claim 1, further including a central pin located at the outlet on each of the individual conveyor screws of said second portion.

5. Screw mill according to claim 1, wherein the individual conveyor screws of the second portion are inserted on the outlet side without a mounting support in said casing.

* * * * *